US010017843B2

(12) United States Patent
Mariani et al.

(10) Patent No.: US 10,017,843 B2
(45) Date of Patent: Jul. 10, 2018

(54) COMPOSITIONS OF PARTICLES COMPRISING RARE-EARTH OXIDES IN A METAL ALLOY MATRIX AND RELATED METHODS

(71) Applicant: BATTELLE ENERGY ALLIANCE, LLC, Idaho Falls, ID (US)

(72) Inventors: Robert D Mariani, Idaho Falls, ID (US); Douglas L Porter, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 1131 days.

(21) Appl. No.: 14/225,306

(22) Filed: Mar. 25, 2014

(65) Prior Publication Data

US 2015/0275337 A1 Oct. 1, 2015

(51) Int. Cl.
*C22C 32/00* (2006.01)
*C22C 33/00* (2006.01)
(Continued)

(52) U.S. Cl.
CPC ..... *C22C 32/0026* (2013.01); *C22C 33/00* (2013.01); *C22C 33/04* (2013.01);
(Continued)

(58) Field of Classification Search
CPC ..... C22C 32/0026; C22C 38/00; C22C 38/02; C22C 38/04; C22C 38/22; C22C 38/24;
(Continued)

(56) References Cited

U.S. PATENT DOCUMENTS 4,075,010 A * 2/1978 Fischer ..... C22C 32/0026 75/235
7,498,005 B2 3/2009 Yadav
(Continued)

FOREIGN PATENT DOCUMENTS

CN 102994884 A 3/2013
EP 2335849 A1 6/2011

OTHER PUBLICATIONS

International Search Report for PCT Application No. PCT/US2015/021063, dated Jun. 24, 2015, 2 pages.
(Continued)

*Primary Examiner* — Jennifer A Smith
*Assistant Examiner* — Alexandra M Moore
(74) *Attorney, Agent, or Firm* — TraskBritt

(57) ABSTRACT

A composition includes a metal alloy matrix comprising iron and a plurality of nanoparticles dispersed within the metal alloy matrix. Each nanoparticle of the plurality comprises an oxide of a rare-earth metal and at least one metal selected from the group consisting of tantalum, niobium, vanadium, and titanium. Some compositions include a metal alloy matrix comprising iron and a plurality of nanoparticles comprising at least two different oxides of rare-earth metals dispersed within the metal alloy matrix. Some methods include mixing an oxide of a rare-earth metal with a first metal and a second metal. Other methods include mixing a plurality of particles comprising at least one oxide of a rare-earth metal with a molten metal comprising iron. Each particle of the plurality may exhibit a density between about 6.9 g/cm$^3$ and about 9.0 g/cm$^3$.

22 Claims, 2 Drawing Sheets

(51) Int. Cl.

| | |
|---|---|
| ***C22C 33/04*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C22C 38/02* (2013.01); *C22C 38/04* (2013.01); *C22C 38/22* (2013.01); *C22C 38/24* (2013.01); *C22C 38/26* (2013.01); *C22C 38/28* (2013.01); *C22C 38/44* (2013.01); *C22C 38/46* (2013.01); *C22C 38/48* (2013.01); *C22C 38/50* (2013.01)

(58) Field of Classification Search
CPC ..... C22C 38/26; C22C 38/28; C22C 38/44; C22C 38/46; C22C 38/48; C22C 38/50
See application file for complete search history.

(56) References Cited

U.S. PATENT DOCUMENTS

| | | | | |
|---|---|---|---|---|
| 7,520,942 | B2 | 4/2009 | Klueh et al. | |
| 8,357,328 | B2 | 1/2013 | Didomizio et al. | |
| 2003/0178104 | A1* | 9/2003 | Sekine | B22F 9/008 148/302 |
| 2008/0135604 | A1 | 6/2008 | Ng et al. | |
| 2010/0119872 | A1* | 5/2010 | Lundeen | B32B 15/011 428/682 |
| 2011/0250074 | A1 | 10/2011 | DiDomizio et al. | |
| 2011/0286563 | A1 | 11/2011 | Moses et al. | |
| 2012/0201341 | A1 | 8/2012 | Mariani | |
| 2013/0152739 | A1 | 6/2013 | Li et al. | |

OTHER PUBLICATIONS

Written Opinion of the International Searching Authority for PCT Application No. PCT/US2015/021063, dated Jun. 24, 2015, 7 pages.

DeCastro et al., "Stability of Nanoscale Secondary Phases in an Oxide Dispersion Strengthened Fe-12Cr Alloy", Acta Materialia 59 (2011) pp. 3927-3936.

Hirata et al., "Atomic Structure of Nanoclusters in Oxide-Dispersion-Strengthened Steels" abstract, Nature Materials 10, 922-926 (2011).

Hsiung, "HRTEM Study of Oxide Nanoparticles in Fe-16Cr ODS Ferritic Steel Developed for Fusion Energy", © FORMATEX 2010, Microscopy: Science, Technology, Applications and Education, pp. 1811-1819.

European Written Opinion, dated Nov. 7, 2017, and Search Report, dated Oct. 31, 2017, for European Application No. 15767762, 11 pages.

Marquis, "Core/shell structures of oxygen-rich nanofeatures in oxide-dispersion strengthened Fe—Cr alloys", Applied Physics Letters, AIP Publishing LLC, US, vol. 93, No. 18, (Nov. 2008), pp. 181904-1-181904-3.

* cited by examiner

COMPOSITIONS OF PARTICLES COMPRISING RARE-EARTH OXIDES IN A METAL ALLOY MATRIX AND RELATED METHODS

GOVERNMENT RIGHTS

This invention was made with government support under Contract No. DE-AC07-ID14517 awarded by the United States Department of Energy. The government has certain rights in the invention.

FIELD

Embodiments of the present disclosure relate generally to iron-based metal alloy compositions having dispersed oxides of rare-earth metals, and to methods of making and using such compositions.

BACKGROUND

Iron-based steel is commonly used in a wide variety of applications. Nano-ferritic alloys and oxide-dispersion strengthened (ODS) steels are alloys having particles of an oxide material (e.g., yttria ($Y_2O_3$)) dispersed within the alloy. ODS steels have enhanced mechanical properties at high temperatures, yet maintain high thermal conductivity and low thermal expansion. The oxide material appears to slow degradation processes, such as recrystallization.

Historical fabrication methods generally employ powder metallurgy to mechanically disperse oxide particles within alloys. Thus, ODS steels are conventionally formed by mechanically alloying powders of the oxide material with the alloy in solid form. Such processes are time-consuming and labor-intensive, making ODS steels relatively expensive and difficult to make in large batches, which affects their limited application in industry. Furthermore, the directionality in microstructures formed during processing, such as rolling to form plates and foils, and extruding to form tubes, generally produces undesirable anisotropic mechanical properties.

The density difference between the oxide particles and the alloy typically prevents welding of ODS steels by conventional techniques such as fusion welding. When ODS steel is melted to form a weld joint, the particles of the oxide material separate from the alloy by density. For example, $Y_2O_3$ has a density of about 5.0 g/cm$^3$, so $Y_2O_3$ particles tend to float to the top of molten steel (which has a density from about 7.75 g/cm$^3$ to about 8.05 g/cm$^3$). ODS steel may be welded by more difficult and expensive techniques, such as magnetic-pulse welding, friction-stir welding, or pressure-resistance welding. Such techniques, which are expensive and experimental, must generally be carefully controlled to limit or prevent melting of the ODS steel because melting of the ODS steel may lead to separation of the oxide material from the bulk alloy.

BRIEF SUMMARY

In some embodiments, a composition includes a metal alloy matrix comprising iron and a plurality of nanoparticles dispersed within the metal alloy matrix. Each nanoparticle of the plurality comprises an oxide of a rare-earth metal and at least one metal selected from the group consisting of tantalum, niobium, vanadium, and titanium.

In other embodiments, a composition includes a metal alloy matrix comprising iron and a plurality of nanoparticles dispersed within the metal alloy matrix. Each nanoparticle of the plurality comprises at least two different oxides of rare-earth metals.

A method includes mixing an oxide of a rare-earth metal with a first metal and a second metal. The first metal comprises iron, and the second metal comprises at least one metal selected from the group consisting of tantalum, niobium, vanadium, and titanium.

In some embodiments, a method includes mixing a plurality of particles comprising at least one oxide of a rare-earth metal with a molten metal comprising iron. Each particle of the plurality may exhibit a density between about 6.9 g/cm$^3$ and about 9.0 g/cm$^3$.

In some embodiments, a composition includes a metal alloy matrix comprising iron and a plurality of nanoparticles dispersed within the metal alloy matrix. The composition exhibits a stress rupture life of at least 50,000 hours at an applied stress of 100 MPa (megapascals) and a temperature of at least 650° C.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

The illustrations presented herein are not actual views of any particular composition or microstructure, but are merely idealized representations that are employed to describe example embodiments of the present disclosure. Additionally, components common between figures may retain the same numerical designation.

Compositions disclosed herein include a metal alloy matrix having dispersed particles including an oxide of a rare-earth metal. The metal alloy matrix may include iron or an iron-containing alloy, such as any of various grades of steel. The particles may optionally include one or more other materials, such a metal having a low solubility in the metal alloy matrix. The particles may be formulated to have a density approximately the same as the density of the metal alloy matrix, such that the particles may remain dispersed in the metal alloy matrix even when the metal alloy matrix is in a liquid state.

Figure 1:
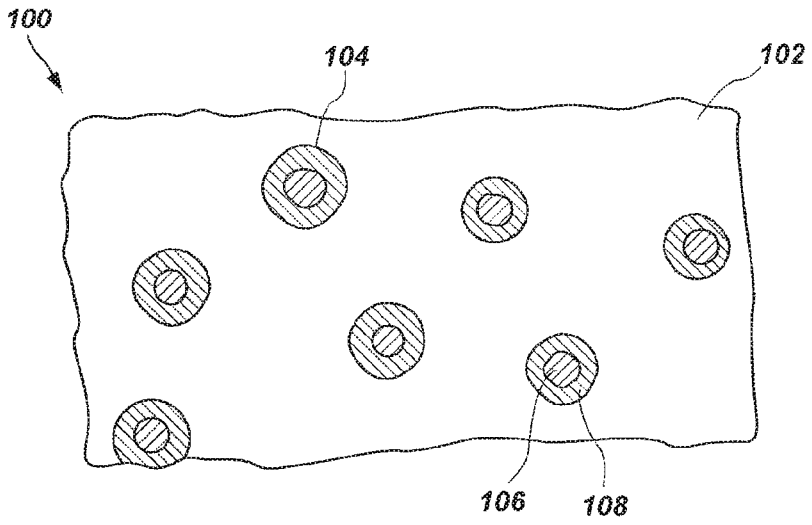
FIGS. 1 through 4 are simplified diagrams illustrating how microstructures of compositions according to the present disclosure may appear under magnification.

FIG. 1 is a simplified diagram illustrating how a microstructure of a composition 100 may appear under magnification. The composition 100 may include a metal alloy 102 and particles 104. The metal alloy 102 forms a continuous matrix surrounding or encapsulating the particles 104. The metal alloy 102 may include iron and any other selected elements, such as carbon, nickel, chromium, molybdenum, manganese, silicon, cobalt, zinc, copper, tungsten, vanadium, or aluminum. As known in the art, various elements in various concentrations may alter properties of the metal alloy 102. For example, elements may improve strength, toughness, elasticity, or any other property of the metal alloy 102.

The particles 104 may include nano-sized particles (i.e., particles having a characteristic dimension, such as a mean diameter, of less than 1 μm). For example, in some embodiments, the particles 104 may have a characteristic dimension of less than about 100 nm, less than about 50 nm, less than about 20 nm, or even less than about 10 nm.

The particles 104 may include a rare-earth oxide 106 (i.e., an oxide of a rare-earth metal), such as an oxide of scandium, yttrium, lanthanum, cerium, praseodymium, neodymium, promethium, samarium, europium, gadolinium, terbium, dysprosium, holmium, erbium, thulium, ytterbium, lutetium, or any combination or mixture of such oxides. For example, the rare-earth oxide 106 may include $Y_2O_3$, $La_2O_3$, $Pr_2O_3$, and/or $Nd_2O_3$. The particles 104 may include one or more distinct phases, and may define a phase boundary between the particles 104 and the metal alloy 102.

The particles 104 may optionally include one or more metals 108, such as tantalum, niobium, vanadium, and/or titanium. The metal 108 may be formulated to promote dispersion of the particles 104 throughout the metal alloy 102. For example, the metal 108 may have a greater affinity for the rare-earth oxide 106 than for a solid phase of the metal alloy 102. The metal 108 may be relatively insoluble in the metal alloy 102 when the metal alloy 102 is in solid form. For example, the metal 108 may have a solubility in the metal alloy 102 of less than about 15 at % (atomic percent), less than about 5 at %, or even less than about 1 at % when the metal alloy 102 is in solid form (e.g., at a temperature of about 100° C. or lower). In some embodiments, the metal 108 may be slightly soluble in the metal alloy 102, and the metal 108 may be present in the composition 100 beyond the solubility limit of the metal 108 in the metal alloy 102. Thus, at least a portion of the metal 108 may be in a distinct phase from the metal alloy 102. For example, the metal 108 may form a coating over the rare-earth oxide 106.

Alternatively, in some embodiments, particles 104 may include oxides of the rare earth metal with the metal 108 and small amounts of oxygen impurities. The oxygen may form complex oxides, such as NbO—$Y_2O_3$, $NbY_2O_4$, $NbY_2O_5$, or $NbYO_4$, even though these complex oxides were not added directly in that form. That is, such complex oxides may form during processing of the composition 100. Furthermore, a mixture of such oxides with metal 108 may be present in particles 104 in some embodiments. Some embodiments may include particles 104 having the metal 108 in addition to small amounts of an oxide of the metal 108 along with the rare-earth oxide 106. For example, particles 104 may include Nb metal with $NbO_2$ and $Y_2O_3$, and the metal alloy 102 may be a distinct phase from the particles 104.

The particles 104 may have approximately the same density (defined for each particle 104 as the mass of that particle divided by its volume) as the metal alloy 102. The rare-earth oxide 106 and the metal 108 may each have different densities, and the particle 104 may have an overall density different from either the rare-earth oxide 106 or the metal 108 alone (e.g., the density of the particle 104 may be between the density of the rare-earth oxide 106 and the density of the metal 108). The particles 104 may have a density within about 10%, within about 5%, within about 2%, or even within about 1% of the density of the metal alloy 102. If the metal alloy has a density of about 7.9 g/cm$^3$, the particles 104 may have a density from about 7.1 g/cm$^3$ to about 8.7 g/cm$^3$, from about 7.5 g/cm$^3$ to about 8.3 g/cm$^3$, from about 7.7 g/cm$^3$ to about 8.1 g/cm$^3$, or from about 7.8 g/cm$^3$ to about 8.0 g/cm$^3$. If the density of the particles 104 is relatively near the density of the metal alloy 102, the particles 104 may tend to remain evenly dispersed even when the metal alloy 102 is in liquid form. Thus, liquid-phase processing operations may be performed on the composition (e.g., centrifugal casting, induction melting, conventional welding, etc.) without introducing composition gradients.

The particles 104 may include a material having a melting temperature above the melting temperature of the metal alloy 102. For example, the rare-earth oxide 106 and/or the metal 108 may remain in solid form even at temperatures at which the metal alloy 102 is a liquid. In some embodiments, the rare-earth oxide 106 may have a melting point above the melting point of the metal alloy 102, and the metal 108 may have melting point below the melting point of the metal alloy 102. In such embodiments, when the composition is heated to a temperature above the melting point of the metal alloy 102, the metal 108 may melt, and may at least partially mix with the metal alloy 102. However, if the metal 108 has a greater affinity for the rare-earth oxide 106 than for a solid phase of the metal alloy 102, the metal 108 may tend to solidify (e.g., precipitate) near the rare-earth oxide 106 as the composition 100 cools. If the metal 108 has a greater affinity for the rare-earth oxide 106 than for the metal alloy 102, the dissolution of the metal 108 in the molten alloy 102 may tend to induce a finer dispersion of the rare-earth oxide 106. Upon cooling the alloy 102, the metal 108 may solidify near the rare-earth oxide 106. The particles having associated rare-earth oxide 106 and metal 108 may influence the retention of the microstructure and mechanical stability of the ODS steel alloy composition 100 at high service temperatures, such as from about 800° C. to about 1,200° C.

As non-limiting examples, the composition 100 may include at least about 0.10% rare-earth oxide 106 by weight, such as from about 0.10% to about 3.00% by weight, or from about 0.25% to about 1.50% by weight. The composition 100 may include from about 50% to about 95% iron by weight, such as from about 60% to about 91% by weight. The composition 100 may also optionally include from about 5% to about 20% chromium by weight, such as from about 9% to about 15% by weight. The composition 100 may include up to about 0.5% carbon by weight, such as from about 0.1% to about 0.25% by weight. The composition 100 may include up to about 20% nickel by weight, such as from about 0.5% to about 15% by weight or from about 5% to about 15% by weight. The composition 100 may include up to about 2.0% molybdenum by weight, such as from about 0.3% to about 1.2% by weight. The composition 100 may include up to about 2.0% manganese by weight, such as from about 0.4% to about 1.6% by weight. The composition 100 may include up to about 1.0% silicon by weight, such as from about 0.4% to about 0.6% by weight.

The composition 100 may include up to about 3.0% of the metal 108 by weight, such as from about 0.1% to about 0.25% by weight. As discussed above, the metal 108, if present, may include one or more of tantalum, niobium, vanadium, and/or titanium. The metal 108 may include any combination of these elements, in any selected concentration. The amount and type of elements of the metal 108 may affect the density and other properties of the metal 108, as well as of the properties of the composition 100.

Figure 2:
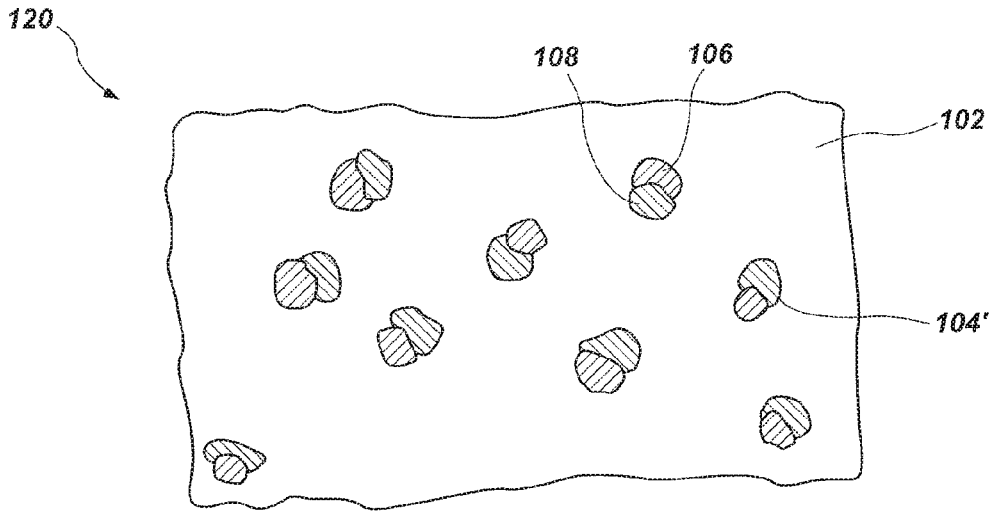

FIG. 2 is a simplified diagram illustrating how a microstructure of another composition 120 may appear under magnification. The composition 120 shown in FIG. 2 includes a metal alloy 102 and particles 104'. The particles 104' shown in FIG. 2 include the metal 108 contacting but not surrounding the rare-earth oxide 106. Thus, the particles 104' may define phase boundaries between more than two solid phases. For example, the particles 104' shown in FIG.

2 define three phase boundaries: a boundary between the metal alloy 102 and the rare-earth oxide 106, a boundary between the metal alloy 102 and the metal 108, and a boundary between the rare-earth oxide 106 and the metal 108. In contrast, the particles 104 shown in FIG. 1 define two phase boundaries: a boundary between the metal alloy 102 and the metal 108 and a boundary between the rare-earth oxide 106 and the metal 108.

Figure 3:
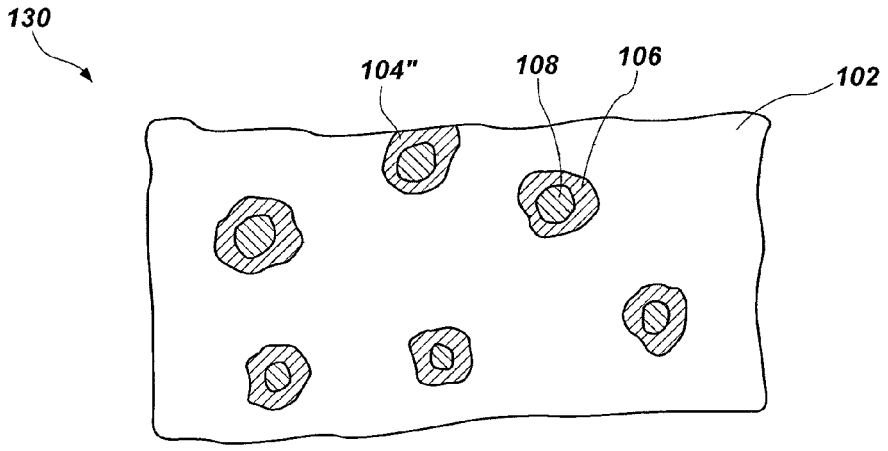

FIG. 3 is a simplified diagram illustrating how a microstructure of another composition 130 may appear under magnification. The composition 130 shown in FIG. 3 includes a metal alloy 102 and particles 104". The particles 104" shown in FIG. 3 include the rare-earth oxide 106 over the metal 108. For example, the metal 108 may be a solid core, and the rare-earth oxide 106 may be a shell or layer over the solid core. The particles 104" shown in FIG. 3 define two phase boundaries: a boundary between the metal alloy 102 and the rare-earth oxide 106 and a boundary between the rare-earth oxide 106 and the metal 108.

Figure 4:
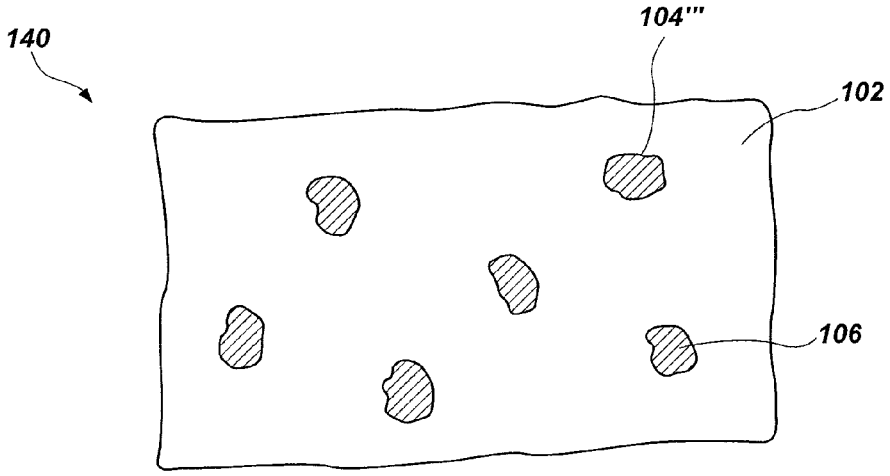

FIG. 4 is a simplified diagram illustrating how a microstructure of another composition 140 may appear under magnification. The composition 140 shown in FIG. 4 includes a metal alloy 102 and particles 104'''. The particles 104''' shown in FIG. 4 include the rare-earth oxide 106. For example, the particles 104''' may be substantially free of a phase of material other than the rare-earth oxide 106. In some embodiments, the rare-earth oxide 106 of the particles 104''' may include at least two different oxides. For example, the rare-earth oxide 106 may include two or more of $Y_2O_3$, $La_2O_3$, $Pr_2O_3$, and $Nd_2O_3$. In some embodiments, the rare-earth oxide 106 may include $Pr_2O_3$ and $Nd_2O_3$.

In some embodiments, compositions may be formed by mixing an oxide of a rare-earth metal with a first metal and a second metal. For example, to form the composition 100 illustrated in FIG. 1, the rare-earth oxide 106 (e.g., an oxide of scandium, yttrium, lanthanum, cerium, praseodymium, neodymium, promethium, samarium, europium, gadolinium, terbium, dysprosium, holmium, erbium, thulium, ytterbium, lutetium, or any combination or mixture of such oxides) may be mixed with the metal alloy 102 (e.g., iron and any other selected elements, such as carbon, nickel, chromium, molybdenum, manganese, silicon, cobalt, zinc, copper, tungsten, vanadium, or aluminum) and the metal 108 (e.g., tantalum, niobium, vanadium, and/or titanium). The metal alloy 102 and the metal 108 may be combined in liquid form (e.g., by stirring, such as by induction melting) before mixing with the rare-earth oxide 106. In some embodiments, the metal alloy 102 and the metal 108 may be uniformly mixed before adding the rare-earth oxide 106. The metal alloy 102, metal 108, and rare-earth oxide 106 may be cast (e.g., centrifugally cast) and cooled to form the composition 100.

In some embodiments, mechanical alloying may be used to form pre-alloys or master alloy precursors. For example, chromium may be milled with the rare-earth oxide 106 to form particles having diameters in the range of 100 to 5,000 microns. The chromium can be combined with the metal 108 and/or the metal alloy 102 while the metal alloy 102 is in a molten state. The material may then be solidified, and the solidified composition may represent the composition 100 or a precursor alloy composition to be added to iron and other components to produce a composition 100. Alternatively, metal 108, such as niobium, may be milled with the rare-earth oxide 106 to form particles in the range of 100 to 5,000 microns or larger.

In certain embodiments, a sub-oxide of niobium, such as NbO or $NbO_2$, may be added to supplement the oxygen content of the alloy in a controlled way. That is, finer control may be exercised over the amount of oxygen added when added as a component of a solid in comparison to the introduction of oxygen as a gas (i.e., as $O_2$ with bubbling, sparging, or other methods). Addition of a sub-oxides of niobium may increase the affinity of the metal 108 toward the rare-earth oxide 106, due to increased affinity of the metal 108 for the sub-oxides of niobium as compared to that for the rare-earth oxide 106, and the expected increased affinity of the rare-earth oxide 106 for the sub-oxides of niobium as compared to that for the metal 108. In general, the oxophilic nature of niobium and the rare-earth metals can be used to adjust to some extent the degree of association of the rare-earth oxide 106 for the metal 108, such that the particles 104 comprise metals 108, rare-earth oxides 106, and complex chemical composites of these constituents with excess oxygen arising from either contaminants or purposeful additions of oxygen-containing compounds such as NbO.

As the metal alloy 102, metal 108, and rare-earth oxide 106 cool from the melt down to room temperature, the metal alloy 102 and the metal 108 may separate based on the solubility of the metal 108 in the metal alloy 102, which may be a function of the temperature of the metal alloy 102, and may change significantly at the freezing point (i.e., melting point) of the metal alloy 102. That is, if the metal 108 is present at a concentration above its solubility limit in a solid form of the metal alloy 102, the metal 108 may form a distinct phase as the materials cool. The metal 108 may coalesce adjacent to the rare-earth oxide 106 to form the particles 104 shown in FIG. 1. For example, the metal 108 may form a coating around the rare-earth oxide 106. In other embodiments, and as shown in FIG. 2, the metal 108 may coalesce adjacent the rare-earth oxide 106 without entirely surrounding the rare-earth oxide 106. In some embodiments, both the metal alloy 102 and the metal 108 may contain some of the same elements. For example, because vanadium has a relatively high solubility in solid iron, if the metal alloy 102 contains iron, the metal alloy 102 and the metal 108 may each contain some vanadium. Other elements of the metal 108 may have a relatively smaller yet finite solubility in the metal alloy 102, but two distinct solid metal phases may still form (i.e., the metal alloy 102 and the metal 108). In some embodiments, a ternary oxide may form, or a series of complex oxides may form partially or completely between the metal 108 and rare-earth oxide 106. For example, excess oxide may be added in controlled amounts in the form of NbO or $NbO_2$ to promote the association of metal 108 and rare-earth oxide 106 as in a Ta—Nb—$NbO_2$—$Y_2O_3$ dispersion.

As a non-limiting example, molten iron may be mixed with molten tantalum and niobium. Particles of $Y_2O_3$ or another rare-earth oxide may be added to this mixture. As another example, molten iron may be mixed with particles of tantalum and niobium and with particles of $Y_2O_3$. In another example, molten iron may be mixed with particles of $Y_2O_3$ coated with tantalum and niobium. The tantalum and niobium may at least partially dissolve during processing.

The particles 104, 104' formed by the rare-earth oxide 106 and the metal 108 may have a density closer to the density of the metal alloy 102 than either the rare-earth oxide 106 or metal 108 alone. That is, as the metal 108 coalesces with the rare-earth oxide 106, the density of the resulting particles 104, 104' may become closer to the density of the metal alloy 102. Thus, the particles 104, 104' may become or remain suspended and/or dispersed in a continuous solid matrix of the metal alloy 102 as the composition 100, 120 cools and solidifies. The composition 100 may be normalized and tempered, such as by heating to dissolve carbon in the metal alloy 102, cooling, and then reheating to a temper, forming fine carbide precipitates.

In some embodiments, compositions may be formed by mixing particles with the metal alloy 102. For example, particles 104 (FIG. 1) including rare-earth oxide 106 with a coating of metal 108 may be mixed with the metal alloy 102. The particles 104 may be formulated to have a similar density to the density of the metal alloy 102, such that the particles 104 disperse in the metal alloy 102, rather than tending to float to the top or sink to the bottom of the metal alloy 102. For example, the particles 104 may exhibit a density from about 6.9 g/cm$^3$ to about 9.0 g/cm$^3$, such as a density within about 10%, within about 5%, within about 2%, or even within about 1% of the density of the metal alloy 102. By matching or nearly matching the density of the particles 104 to the density of the metal alloy 102, the composition 100 need not be formed by powder metallurgy, and the metal alloy 102 may be processed in liquid form. Processing the metal alloy 102 as a liquid simplifies large-scale operations, and makes it possible to use the composition 100 in a wider variety of applications for which powder metallurgy is not feasible.

The composition 100 is hereby derived from unique and novel design and control of three forces: solubility, chemical affinity, and density. The solubility of tantalum and niobium in solid iron alloys 102 is low enough to cause tantalum and niobium to precipitate from alloy 102 during and/or after solidification. In the molten state prior to solidification, the chemical affinity of the metal 108 toward oxygen may cause oxygen (whether from incidental impurities or purposeful additions) to concentrate more strongly toward the metal 108 as compared to iron in the alloy 102. The chemical affinity of the metal 108 for oxygen will also induce association of the metal 108 with the rare-earth oxide 106. The oxygen that concentrates with metals 108 may augment the tendency for the metal 108 to associate with the rare-earth oxide 106, because oxides tend to separate from metals. The association of particles 104 (i.e., the agglomeration of the rare-earth oxide 106 with the metal 108) therefore presents a range of possible interactions between metals 108 and rare-earth oxides 106 such that additional oxygen impurities may be present, sub-oxides of metals may be present, or more complicated ternary and quaternary oxide phases may be present, any of which may form while the alloy 102 is molten or upon solidification of the alloy 102. The individual components that make up the compositions are selected so that the association of the chemical components of the particles 104 will tend to maintain their isolable association during fusion welding with a density that tends toward the density of the molten alloy 102. Fine control of the density through judicious choices of chemical components of the particles 104 will tend toward fine control of conventional fusion welding behavior and performance.

In some embodiments, particles may be formed having a mean particle diameter of less than about 100 nm, less than about 50 nm, or even less than about 10 nm. The particles may form during cooling (e.g., by the coalescing of metal 108 adjacent rare-earth oxide 106), or may be formed prior to introducing particles to the metal alloy 102. For example, to form the composition 130 shown in FIG. 3, particles 104" comprising cores of metal 108 may be coated with a rare-earth oxide 106 before mixing the particles 104" with the metal alloy 102. The metal 108 may remain distinct from the metal alloy 102 throughout mixing and cooling of the composition 130.

In some embodiments, particles may be formed having a ratio of metal 108 to rare-earth oxides 106 from 0 (zero, i.e., no metal 108) to about 5 by weight (i.e., about five times as much rare-earth oxide 106 as metal 108 by weight).

The compositions formed may optionally be reheated to a melting temperature of the metal alloy 102, such that the compositions 100, 120, 130, 140 (FIGS. 1-4) may be welded or otherwise processed. During the reheating process, the particles 104, 104', 104", 104''' may remain suspended or dispersed in the metal alloy 102, rather than tending to float to the top or sink to the bottom of the composition 100, 120, 130, 140. Thus, portions of the compositions 100, 120, 130, 140 may be welded or secured to other portions of the compositions 100, 120, 130, 140 by conventional means, and without introducing a gradient of particle concentration in the volumes of the compositions 100, 120, 130, 140 joined together. Weldability may be improved or optimized by making small adjustments to the amounts of the rare-earth oxide 106 or metal 108 in the composition. For example, the density may be increased with small positive increments in the amount of more-dense components, (e.g., replacing Nb, V, or $Nd_2O_3$ with Ta; replacing $Y_2O_3$ with $Nd_2O_3$). Likewise, the density may be decreased with small positive increments in the amount of less-dense components (e.g., replacing Ta with Nb or replacing Fe with V). Optimization of alloy 102 to have selected properties, such as resistance to corrosion using minor amounts of elements such as chromium, may modify the density of the liquid alloy. Maintaining the density of the alloy 102 and the density of the particles 104, 104', 104", 104''' to be the same or nearly the same will tend to optimize weldability.

In some embodiments, compositions may be formed by mixing a plurality of particles comprising at least one oxide of a rare-earth metal with a molten metal comprising iron. The particles may exhibit a density between about 6.9 g/cm$^3$ and about 9.0 g/cm$^3$, and may exhibit a density close to the density of the molten metal. The particles may include two or more rare-earth oxides, such as $Pr_2O_3$ and $Nd_2O_3$, $Y_2O_3$ and $Nd_2O_3$, or $Y_2O_3$ and $La_2O_3$. For example, the composition 140 shown in FIG. 4 may be formed by mixing particles 104''' comprising a rare-earth oxide 106 with a metal alloy 102. Though the rare-earth oxide 106 may include two or more oxides of different compositions, the particles 104''' may be substantially free of material other than the rare-earth oxide 106.

Particles 104 (FIG. 1), 104' (FIG. 2), and 104" (FIG. 3) may be processed similarly, by mixing particles already formed with the metal alloy 102 to form compositions 100 (FIG. 1), 120 (FIG. 2), and 130 (FIG. 3).

In some embodiments, particles including a rare-earth oxide 106 over a metal 108, such as the particles 104" shown in FIG. 3, may tend to break during processing. The cores of metal 108 melt and tend to weaken the rare-earth oxide 106 coating such that the rare-earth oxide 106 may break into smaller particles. The metal 108 may mix with the metal alloy 102. The composition is then cooled. The solubility of the metal 108 in a solid form of the metal alloy 102 may be relatively low, so relatively small portions of the metal 108 remain dissolved in the metal alloy 102 after cooling. During cooling of the composition, the metal 108 may coat the smaller particles of the rare-earth oxide 106 formed by the breaking of the particles 104". Thus, a microstructure of the cooled composition may appear as the microstructures of the compositions 100 (FIG. 1) or 120 (FIG. 2).

Compositions described herein may exhibit enhanced performance with respect to conventional materials. For example, composition as described may exhibit a stress rupture life of at least about 50,000 hours at an applied stress of 100 MPa (megapascals) at temperatures of at least 650° C. or at temperatures of at least 750° C. Iron-based ODS alloys generally provide increased properties in a temperature range from about 650° C. to about 850° C. At lower temperatures, the benefits of the dispersed oxide are not generally needed. At higher temperatures, accelerated oxidation and microstructural changes may warrant the use of high-nickel alloys instead of iron-based ODS alloys.

EXAMPLES

Example 1: Niobium-Coated Yttria Particles in Steel

Yttria ($Y_2O_3$) is milled with niobium (Nb) to form particles having a mean diameter between 1 and 750 microns. The yttria is impregnated in the niobium metal, forming particles of varying concentrations of the components. Some unassociated particles of yttria may remain. The outside diameter of the particles may be less than about 7 nm. The particles are added to a liquid steel alloy, such that the overall composition includes about 1.0% yttria, about 2.0% niobium, and 9%-15% chromium (Cr), with the balance iron (Fe). The niobium coating melts and mixes with the steel alloy. The composition is then cooled. The solubility of the niobium in solid steel is relatively low, so a relatively small portion of the niobium remains dissolved in the steel alloy after cooling. During cooling of the composition, the niobium remains associated with the yttria particles.

Alternatively, a precursor alloy of iron that is high in niobium and chromium can be milled with yttria prior to addition to a liquid steel alloy such that their addition reduces the amount of chromium and niobium needed to reach a desired final alloy composition.

Alternatively, uncoated yttria particles may be combined with a liquid mixture of the niobium, chromium, and iron. In the molten state, the mixture may be centrifugally cast or inductively stirred to promote a uniform distribution. The mixture may then be cooled, during which the niobium tends to remain associated with the yttria to form isolable particles that may be observable with a transmission electron microscope, for example. The niobium may partially or completely encase the yttria, with yttria presenting itself as the core of the particle.

The result of any of these alternative processes is a continuous matrix of steel with particles of niobium-coated yttria dispersed throughout. The density of the particles may vary based on the size of the yttria cores and the concentrations of yttria and niobium.

Example 2: Niobium- and Tantalum-Coated Yttria Particles in Steel

Yttria ($Y_2O_3$) is milled with $NbO_2$, niobium (Nb), and tantalum (Ta) to form particles having a mean diameter between 500 and 750 microns. The $NbO_2$ and yttria are impregnated in the metal niobium and tantalum. The presence of the $NbO_2$ augments the oxygen level in a controlled way and decreases the time required for milling as compared to its absence. The particles are added to a liquid steel alloy, such that the overall composition includes about 1.0% yttria, about 1.4% niobium, 0.2% $NbO_2$, 0.4% tantalum, and 9%-15% chromium, with the balance iron. The niobium and tantalum coating dissolves and mixes with the steel alloy. The composition is then cooled. The solubilities of the niobium and tantalum in solid steel are relatively low, so relatively small portions of the niobium and tantalum remain dissolved in the steel alloy after cooling. During cooling of the composition, the niobium and tantalum coat the yttria particles again.

Alternatively, uncoated yttria particles may be combined with a liquid mixture of the niobium, $NbO_2$ and/or NbO, tantalum, chromium, and iron. The mixture may then be cooled from the molten state, during which the niobium and tantalum associate with the yttria particles.

The result of either process is a continuous matrix of steel with particles of niobium- and tantalum-coated yttria dispersed throughout. The density of the particles may vary based on the size of the yttria cores and the concentrations of yttria, niobium, and tantalum. For example, because tantalum is approximately twice as dense as niobium, particles having a higher density may be formed by increasing the ratio of tantalum to niobium. Likewise, particles having a lower density may be formed by decreasing the ratio of tantalum to niobium.

Example 3: Yttria-Coated Niobium and Tantalum Particles in Steel

Niobium and tantalum are milled with yttria powder to form particles having a mean diameter of less than 500 microns. The particles are added to a liquid steel alloy, such that the overall composition includes about 1.0% yttria, about 1.6% niobium, 0.4% tantalum, and 9%-15% chromium, with the balance iron. The niobium and tantalum cores dissolve and tend to weaken the yttria coating such that the yttria coating may break into smaller particles. The niobium and tantalum mix with the steel alloy. The composition is then cooled. The solubilities of the niobium and tantalum in solid steel are relatively low, so relatively small portions of the niobium and tantalum remain dissolved in the steel alloy after cooling. During cooling of the composition, the niobium and tantalum coalesce adjacent the smaller yttria particles formed from the yttria coating. By breaking the yttria into smaller particles, the number of yttria-niobium-tantalum particles may be increased, thus decreasing the average separation between adjacent particles.

Examples 4-18: Other Sample Compositions in Cr/Fe Alloy

Compositions are formed as described in any of Examples 1 through 3, with the rare-earth oxides and metal phase shown in Table 1 forming the particles. The concentrations shown in Table 1 are in percent, based on the total mass of the composition, with the balance being a steel alloy comprising chromium and iron (i.e., composition #4 has an iron concentration of 82.1%-88.1%).

TABLE 1

| Sample Compositions | | | | | | | | | |
|---|---|---|---|---|---|---|---|---|---|
| | Rare-earth oxides | | | | Metal Phase | | | | Alloy (balance Fe and optionally C) |
| | $Y_2O_3$ | $La_2O_3$ | $Pr_2O_3$ | $Nd_2O_3$ | V | Nb | Ta | Ti | Cr |
| 4 | 0.90 | | | 0.10 | | 1.90 | | | 9-15 |
| 5 | 1.00 | | | | | 1.80 | 0.10 | | 9-15 |
| 6 | 0.75 | | | 0.25 | 0.25 | 1.75 | | | 9-15 |
| 7 | 0.25 | | | | 0.18 | 0.57 | 0.04 | | 9-15 |
| 8 | 0.70 | | | | | 1.50 | | | 9-15 |
| 9 | 0.14 | | | 0.36 | | 0.25 | | | 9-15 |
| 10 | | 1.00 | | | 0.80 | 1.00 | | | 9-15 |
| 11 | 0.23 | 0.77 | | | | 0.77 | | | 9-15 |
| 12 | 0.25 | 1.00 | | | | 0.50 | 0.13 | | 9-15 |
| 13 | | | | 1.00 | | 0.90 | | 0.40 | 9-15 |
| 14 | | | | 0.75 | | | | 0.05 | 9-15 |
| 15 | | | 0.77 | 0.23 | | | | | 9-15 |
| 16 | | | 0.77 | 0.23 | 0.54 | 0.42 | | | 9-15 |
| 17 | | | 0.77 | 0.23 | 1.08 | 0.85 | | | 9-15 |
| 18 | | | 0.77 | 0.23 | 0.27 | 0.22 | | | 9-15 |

The particles formed of each of the compositions 4-18 are predicted to have an average density near the density of iron at melt-process temperatures. Thus, the particles should remain suspended during processing. In each of the compositions 15-18, the rare-earth oxides and the metal phase each independently has an average density near the density of iron at melt-process temperatures, such that the material should remain suspended during processing even if not associated as heterogeneous particles of rare-earth oxides and metal.

Examples 19-23: Other Sample Compositions

Compositions are formed as described in any of Examples 1 through 3, with the rare-earth oxides and metal phase shown in Table 2 forming the particles. The steel alloy comprises one or more of carbon, nickel, chromium, molybdenum, manganese, and silicon, with the balance iron. The concentrations shown in Table 2 are in percent, based on the total mass of the composition (i.e., composition #19 has an iron concentration of 85.40%-85.65%).

TABLE 2

| Sample Compositions | | | | | | | | | | | | | | |
|---|---|---|---|---|---|---|---|---|---|---|---|---|---|---|
| | Rare-earth oxides | | | | Metal Phase | | | | Alloy (balance Fe) | | | | | |
| | $Y_2O_3$ | $La_2O_3$ | $Pr_2O_3$ | $Nd_2O_3$ | V | Nb | Ta | Ti | C | Ni | Cr | Mo | Mn | Si |
| 19 | 0.75 | 0.00 | 0.00 | 0.25 | 0.25 | 1.75 | 0.00 | 0.00 | 0-0.25 | 0.5 | 9 | 1 | 0.45 | 0.4 |
| 20 | 0.14 | 0.00 | 0.00 | 0.36 | 0.00 | 0.25 | 0.00 | 0.00 | 0-0.15 | 0 | 9 | 1 | 0.45 | 0.6 |
| 21 | 0.00 | 0.00 | 0.00 | 1.00 | 0.00 | 0.90 | 0.00 | 0.40 | 0-0.15 | 15 | 15 | 1.2 | 1.6 | 0.5 |
| 22 | 0.25 | 0.00 | 0.00 | 0.00 | 0.18 | 0.57 | 0.04 | 0.00 | 0-0.02 | 0 | 14 | 0.3 | 0 | 0 |
| 23 | 0.00 | 0.00 | 0.38 | 0.12 | 0.54 | 0.42 | 0.00 | 0.00 | 0-0.1 | 0 | 14 | 0.3 | 0 | 0 |

The particles formed of each of the compositions 19-23 are predicted to have an average density near the density of the steel alloy at melt-process temperatures. Thus, the particles should remain suspended during processing.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, embodiments of the disclosure have utility with different and various compositions.

What is claimed is:

1. A composition, comprising:

a metal alloy matrix comprising iron; and a plurality of nanoparticles dispersed within the metal alloy matrix, wherein each nanoparticle of the plurality comprises a first phase comprising an oxide of a rare-earth metal and a second phase comprising at least one metal selected from the group consisting of tantalum, niobium, vanadium, and titanium.

2. The composition of claim 1, wherein the at least one metal comprises tantalum and at least one of niobium and vanadium.

3. The composition of claim 1, wherein the nanoparticles of the plurality exhibit a density within 2% of a density of the metal alloy matrix.

4. The composition of claim 1, wherein the nanoparticles of the plurality exhibit a density within 1% of a density of the metal alloy matrix.

5. The composition of claim 1, wherein each nanoparticle of the plurality comprises at least one oxide selected from the group consisting of oxides of scandium, yttrium, lanthanum, cerium, praseodymium, neodymium, promethium, samarium, europium, gadolinium, terbium, dysprosium, holmium, erbium, thulium, ytterbium, and lutetium.

6. The composition of claim 5, wherein each nanoparticle of the plurality comprises at least one material selected from the group consisting of $Y_2O_3$, $La_2O_3$, $Pr_2O_3$, and $Nd_2O_3$.

7. The composition of claim 1, wherein each nanoparticle of the plurality exhibits a particle diameter of less than 10 nm.

8. The composition of claim 1, wherein at least a portion of each nanoparticle of the plurality is formulated to form a distinct phase from the metal alloy matrix at a temperature below a melting temperature of the metal alloy matrix.

9. The composition of claim 1, wherein the oxide of a rare-earth metal exhibits a melting temperature above a melting temperature of the metal alloy matrix.

10. The composition of claim 1, wherein the composition comprises from 0.25% to 1.25% by weight of the oxide of the rare-earth metal, and from 0.25% to 2.0% by weight of a total of the at least one metal selected from the group consisting of tantalum, niobium, vanadium, and titanium.

11. The composition of claim 1, wherein the composition comprises from 60% to 90% by weight iron.

12. The composition of claim 1, wherein at least some nanoparticles of the plurality comprise a coating of the second phase at least partially over the first phase.

13. A method, comprising:

mixing an oxide of a rare-earth metal with a first metal and a second metal, wherein the first metal comprises iron, and wherein the second metal comprises at least one metal selected from the group consisting of tantalum, niobium, vanadium, and titanium; and cooling the mixture to form a metal alloy matrix comprising iron and a plurality of nanoparticles dispersed in the metal alloy matrix, the nanoparticles each comprising a first phase comprising the oxide of the rare-earth metal and a second phase comprising the second metal.

14. The method of claim 13, wherein cooling the mixture to form a metal alloy matrix comprises forming a plurality of nanoparticles exhibiting a particle diameter of less than 10 nm.

15. The method of claim 13, further comprising reheating at least a portion of the mixture to fusion-weld at least a portion of the mixture to another portion of a metal alloy matrix comprising iron and a plurality of nanoparticles comprising the second metal and the oxide of the rare-earth metal.

16. The method of claim 13, wherein the first metal comprises an iron alloy.

17. The method of claim 13, wherein mixing an oxide of a rare-earth metal with a first metal and a second metal comprises forming a mixture of the first metal and the second metal, wherein each of the first metal and the second metal is in a liquid state.

18. The method of claim 13, wherein mixing an oxide of a rare-earth metal with a first metal and a second metal comprises mixing the first metal with particles comprising the second metal and the oxide of the rare-earth metal.

19. The method of claim 18, wherein mixing an oxide of a rare-earth metal with a first metal and a second metal comprises mixing the first metal with nanoparticles comprising the second metal surrounding the oxide of the rare-earth metal.

20. The method of claim 19, wherein each nanoparticle of the plurality comprises a coating of Nb over a core of $Y_2O_3$.

21. The method of claim 19, wherein mixing an oxide of a rare-earth metal with a first metal and a second metal comprises mixing the first metal with a plurality of nanoparticles comprising the oxide of a rare-earth metal surrounding the second metal.

22. The method of claim 21, wherein each nanoparticle of the plurality comprises a coating of $Y_2O_3$ over a core of an alloy comprising Ta and Nb.

* * * * *